US008591266B2

(12) United States Patent
Kondo et al.

(10) Patent No.: US 8,591,266 B2
(45) Date of Patent: Nov. 26, 2013

(54) ELECTRICAL WIRING STRUCTURE

(75) Inventors: Jun Kondo, Nagoya (JP); Kazufumi Serizawa, Kariya (JP); Shu Kagami, Nagoya (JP)

(73) Assignee: Denso Corporation, Kariya (JP)

( * ) Notice: Subject to any disclaimer, the term of this patent is extended or adjusted under 35 U.S.C. 154(b) by 26 days.

(21) Appl. No.: 13/313,523

(22) Filed: Dec. 7, 2011

(65) Prior Publication Data

US 2012/0149252 A1 Jun. 14, 2012

(30) Foreign Application Priority Data

Dec. 8, 2010 (JP) ..... 2010-273575

(51) Int. Cl.
*H01R 13/625* (2006.01)

(52) U.S. Cl.
USPC ..... 439/668

(58) Field of Classification Search
USPC ..... 439/668–669, 502, 638, 660
See application file for complete search history.

(56) References Cited

U.S. PATENT DOCUMENTS

| | | | | |
|---|---|---|---|---|
| 4,375,220 | A * | 3/1983 | Matvias | 607/102 |
| 5,220,927 | A * | 6/1993 | Astrahan et al. | 607/156 |
| 5,228,441 | A * | 7/1993 | Lundquist | 600/380 |
| 5,273,535 | A * | 12/1993 | Edwards et al. | 604/95.01 |
| 5,313,943 | A * | 5/1994 | Houser et al. | 600/374 |
| 6,454,597 | B1 * | 9/2002 | Marsh et al. | 439/502 |
| 6,870,109 | B1 * | 3/2005 | Villarreal | 174/102 R |
| 7,052,491 | B2 * | 5/2006 | Erb et al. | 606/17 |
| D525,199 | S * | 7/2006 | Lin | D13/133 |
| 7,806,714 | B2 * | 10/2010 | Williams et al. | 439/352 |
| 8,186,034 | B2 * | 5/2012 | Vitito | 29/433 |
| 8,273,079 | B2 * | 9/2012 | Hoey et al. | 606/27 |
| 2005/0162147 | A1 * | 7/2005 | Cannon | 324/72.5 |
| 2010/0252002 | A1 | 10/2010 | Fujino et al. | |

FOREIGN PATENT DOCUMENTS

| | | |
|---|---|---|
| JP | 2010-242574 | 10/2010 |

* cited by examiner

*Primary Examiner* — Jean F Duverne
(74) *Attorney, Agent, or Firm* — Nixon & Vanderhye PC

(57) ABSTRACT

An electrical wiring structure of connecting between a first component and a second component with at least four lead wires includes the first component provided with first insertion portions in which the lead wires are inserted, and the first insertion portions 15 are arranged in two lines and j columns, and the second component provided with second insertion portions in which the lead wires are inserted, and the second insertion portions are in two lines and j columns. Ends of a pair of lead wires are inserted into the first insertion portions and other ends of the pair of lead wires are inserted into the second insertion portions after crossing at an intermediate part.

10 Claims, 8 Drawing Sheets

ELECTRICAL WIRING STRUCTURE

This application is based on and claims the benefit of priority from earlier Japanese Patent Application No. 2010-273575 filed Dec. 8, 2010, the description of which is incorporated herein by reference.

TECHNICAL FIELD

The present disclosure relates to an electrical wiring structure of connecting between two components with a plurality of lead wires.

BACKGROUND

Disposing a pressure sensor that detects a pressure of a fuel injected into cylinders of an internal-combustion engine into a body of an injector as an injector that injects fuel into the cylinders of the internal-combustion engine is proposed.

Moreover, the body of the injector is provided with a connector unitarily, and terminals of the connector are electrically connected with the pressure sensor (refer to Japanese Patent Application Laid-Open Publication No. 2010-242574, for example).

By the way, inventors of the present disclosure considered abolishing the connector disposed unitarily to the body of the injector mentioned above, and considered an injector having a composition of electrically connecting lead wires with terminals of a connector disposed separately from a body of the injector after leading out the lead wires electrically connected to a pressure sensor.

FIG. 7A and FIG. 7B show a considered proposal of an injector 1 that is provided with a connector 2 separately from a body of the injector 1, and the connector 2 is connected with the injector 1 by the six lead wires 3.

However, with the composition of this injector 1, since a bending radius R of some lead wires may become remarkably small compared with other lead wires when the lead wires 3 are needed to be bent for use, as shown in FIG. 8 for example, there is a problem that it is difficult to bend the lead wires 3.

Especially, this problem becomes remarkable when using a lead wire 3 having a thick wire diameter because of a large current, etc.

Moreover, since the restoring force between different lead wires differ significantly, i.e., since the restoring force is unbalanced, there is a problem that the lead wires 3 will be twisted even if the lead wires 3 are required to maintain a particular bending direction after installing the injector 1 to the internal-combustion engine.

SUMMARY

An embodiment provides an electrical wiring structure that enables an easy bending of lead wires.

In an electrical wiring structure according to a first aspect, the electrical wiring structure of connecting between a first component and a second component with at least four lead wires includes the first component provided with first insertion portions in which the lead wires are inserted, and the first insertion portions are arranged in two lines and j columns, and the second component provided with second insertion portions in which the lead wires are inserted, and the second insertion portions are in two lines and j columns.

Ends of a pair of lead wires are inserted into the first insertion portions and other ends of the pair of lead wires are inserted into the second insertion portions after crossing at an intermediate part.

Accordingly, when the lead wires are bent in the crossing direction of the pair of lead wires of each column, the bending radius of each lead wire becomes substantially equal.

Moreover, since the bending radius becomes relatively large, the lead wires can be bent easily.

Further, since the restoring force of each lead wire becomes substantially equal, i.e., since the balance of restoring force becomes sufficient, a twist of the lead wire hardly occurs.

Furthermore, since it is hard to bend the wires in the non-crossing direction Y, it is easy to maintain a bending direction of the lead wires.

In the electrical wiring structure according to a second aspect, wherein, all of the lead wires have equal length.

In the electrical wiring structure according to a third aspect, the electrical wiring structure of connecting between a first component and a second component with at least six lead wires includes the first component provided with first insertion portions in which the lead wires are inserted, and the first insertion portions are arranged in three lines and j columns, and the second component provided with second insertion portions in which the lead wires are inserted, and the second insertion portions are in three lines and j columns.

Among the three lead wires of each column, the lead wire inserted into the second line of the first insertion portion is inserted into the second line of the second insertion portion, and the lead wire inserted into the first line of the first insertion portion and the lead wire inserted into the third line of the first insertion portion are inserted into the second insertion portion after crossing at an intermediate part.

In the electrical wiring structure according to a fourth aspect, among the three lead wires of each column, the lead wire inserted into the first line of the first insertion portion and the lead wire inserted into the third line of the first insertion portion have the same length, and are longer than the lead wire inserted into the second line of the first insertion portion.

In the electrical wiring structure according to a fifth aspect, the first component is an injector that injects fuel into cylinders of an internal-combustion engine, and the second component is a connector.

DETAILED DESCRIPTION OF THE PREFERRED EMBODIMENTS

Figure 1B:
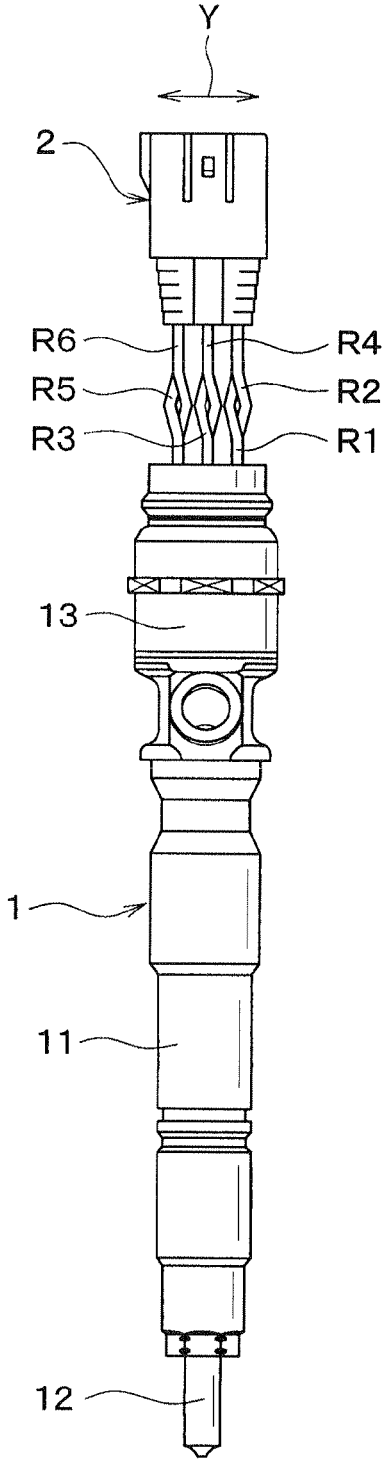
FIG. 1B shows a left-hand side view of the injector shown in FIG. 1A.

With reference to the drawings, hereinafter will be described an embodiment of the present disclosure.

It should be appreciated that, in the following embodiments, the components identical with or similar maturely are given the same reference numerals for the sake of omitting explanation.

(First Embodiment)

A first embodiment of the present disclosure is explained.

Figure 1A:
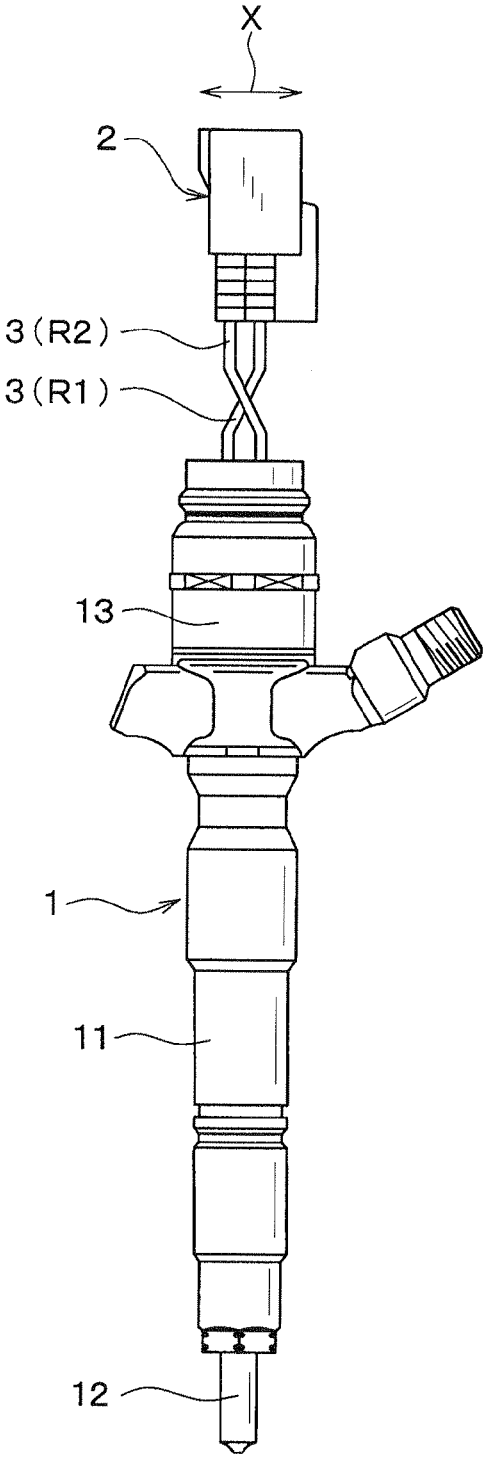
FIG. 1A shows an elevational view of an injector in which an electrical wiring structure of a first embodiment of the present disclosure is adopted.
Figure 2A:
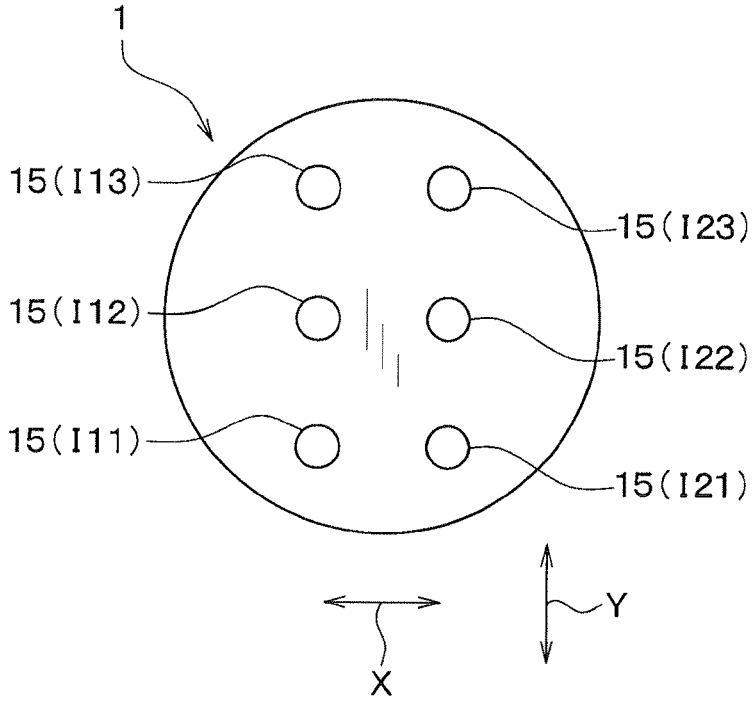
FIG. 2A shows a schematic view showing an arrangement of a first insertion portion of the injector shown in FIG. 1A.
Figure 2B:
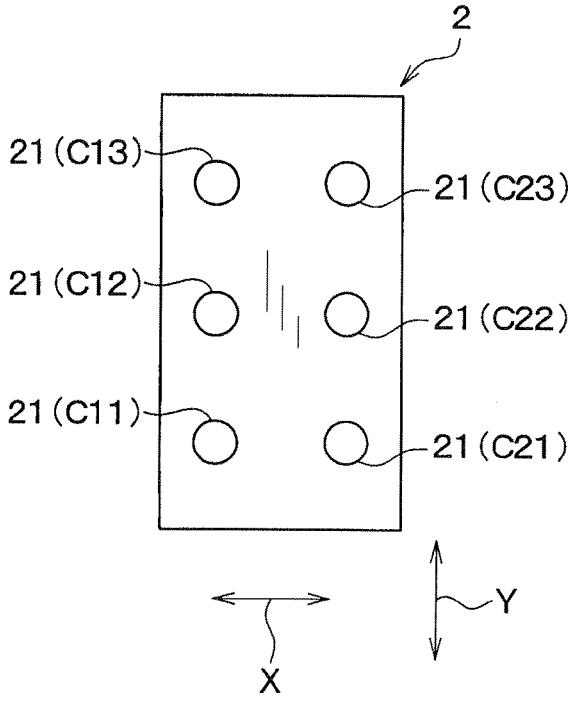
FIG. 2B shows a schematic view showing an arrangement of a second insertion portion of a connector shown in FIG. 1A.

In addition, FIG. 2A and FIG. 2B are views that each viewed from a top of FIG. 1A (namely, plan views).

As shown in FIG. 1, an injector 1 as a first component is provided with a lower body 11, and a high-pressure fuel passage (not shown) where a high-pressure fuel supplied from a common-rail (not shown) flows is formed within the lower body 11.

The high-pressure fuel is injected into cylinder(s) of a diesel internal-combustion engine (not shown) from a nozzle 12 disposed at a lower end of the lower body 11.

A cylindrical upper body 13 is screwed to an upper end of the lower body 11, and a pressure sensor (not shown) that detects a fuel pressure of the high-pressure fuel passage is disposed in a space inside the upper body 13.

A connector 2 as a second component is formed separately from the injector 1, and the pressure sensor of the injector 1 and terminals (not shown) of the connector 2 are electrically connected with six lead wires 3. All of the six lead wires 3 have equal length.

In addition, the term "length of the lead wire 3" in the present specification is the length of the part between the injector 1 and the connector 2. Moreover, the six lead wires 3 are separately denoted by R1-R6 among FIG. 1A and FIG. 1B.

As shown in FIG. 2A, the injector 1 is provided with six first insertion portions 15 in which the lead wires 3 are inserted, and the first insertion portions 15 are arranged in two lines of three columns.

In addition, the six first insertion portions 15 are separately denoted by Iij among FIG. 2A, where i denotes a line number and j denotes a column number.

As shown in FIG. 2B, the connector 2 is provided with six second insertion portions 21 in which the lead wires 3 are inserted, and the second insertion portions 21 are arranged in two lines of three columns.

In addition, the six second insertion portions 21 are separately denoted by Cij among FIG. 2B, where i denotes a line number and j denotes a column number.

Incidentally, end sides of the lead wires 3 enter into the injector 1 through the first insertion portions 15, and are electrically connected with the pressure sensor.

Moreover, other end sides of the lead wires 3 enter in the connector 2 through the second insertion portions 21, and are electrically connected with the terminals.

In FIG. 1A, FIG. 1B, FIG. 2A, and FIG. 2B, every two of the six lead wires 3 are arranged at each column.

For the first lead wire R1 arranged at the first column, one end thereof is inserted into the first insertion portion I11 at the first line of the first column, and the other end thereof is inserted into the second insertion portion C21 at the second line of the first column.

Moreover, for the second lead wire R2 arranged at the first column, one end thereof is inserted into the first insertion portion 121 at the second line of the first column, and the other end thereof is inserted into the second insertion portion C11 at the first line of the first column.

Thereby, a pair of lead wires R1 and R2 of the first column crosses at an intermediate part (refer to FIG. 1A).

For the third lead wire R3 arranged at the second column, one end thereof is inserted into the first insertion portion 112 at the first line of the second column, and the other end thereof is inserted into the second insertion portion C22 at the second line of the second column.

Moreover, for the fourth lead wire R4 arranged at the second column, one end thereof is inserted into the first insertion portion 122 at the second line of the second column, and the other end thereof is inserted into the second insertion portion C12 at the first line of the second column.

Thereby, a pair of lead wires R3 and R4 of the second column crosses at an intermediate part.

For the fifth lead wire R5 arranged at the third column, one end thereof is inserted into the first insertion portion 113 at the first line of the third column, and the other end thereof is inserted into the second insertion portion C23 at the second line of the third column.

Moreover, for the sixth lead wire R6 arranged at the third column, one end thereof is inserted into the first insertion portion 123 at the second line of the third column, and the other end thereof is inserted into the second insertion portion C13 at the first line of the third column.

Thereby, a pair of lead wires R5 and R6 of the third column crosses at an intermediate part.

In addition, a direction where the lead wires of each column crosses is shown by an arrow as an crossing direction X in FIG. 1A, FIG. 1B, FIG. 2A, and FIG. 2B.

Moreover, a direction that intersects perpendicularly to the crossing direction X and an axis of the injector 1 is shown by an arrow as a non-crossing direction Y.

Figure 3:
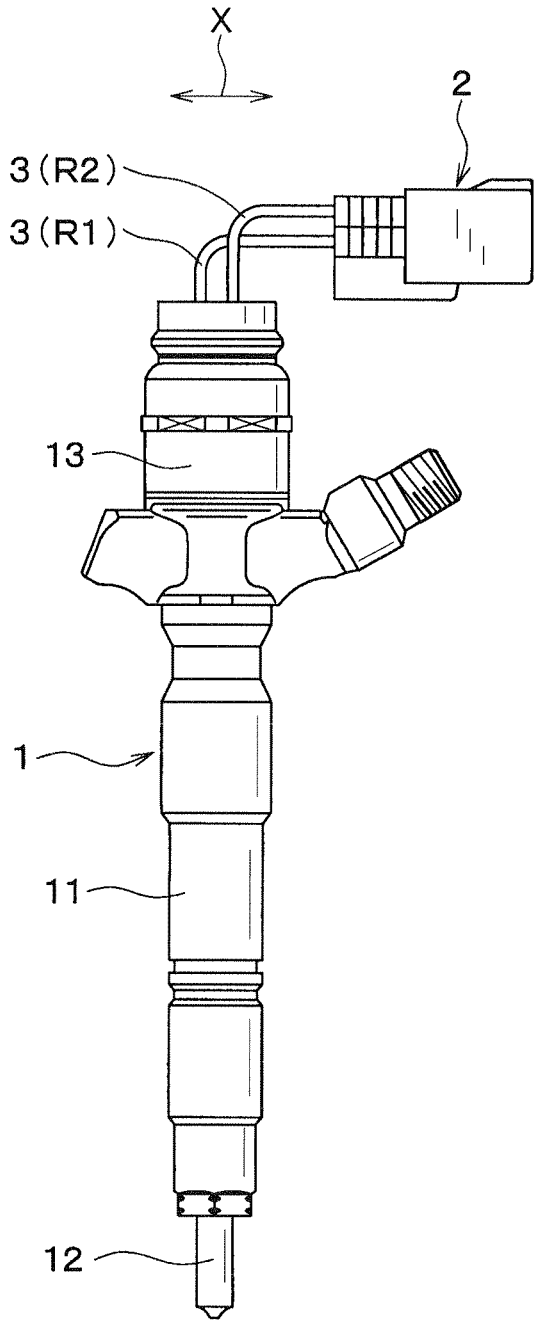
FIG. 3 shows an elevational view of the injector shown in FIG. 1A in a usage state.

When the lead wires 3 are bent in the crossing direction X of the pair of lead wires of each column, bending radius R of each lead wire 3 becomes substantially equal, as shown in FIG. 3, in the injector 1 with the above composition.

Moreover, since the bending radius R becomes relatively large, the lead wires 3 can be bent easily.

Further, since the restoring force of each lead wire 3 becomes substantially equal, i.e., since the balance of restoring force becomes sufficient, a twist of the lead wire 3 hardly occurs.

Furthermore, since it is hard for the lead wires 3 to bend in the non-crossing direction Y, it is easy to maintain a bending direction of the lead wires 3.

In addition, when connecting between two components with the two lead wires 3, the problem of the lead wires 3 being hard to bend does not occur.

Therefore, the electrical wiring structure according to the present embodiment is effective when using at least four lead wires 3 that connect between two components.

In this case, the first insertion portions 15 and the second insertion portions 21 are arranged in two lines and j columns (however, 2<=j).

(Second Embodiment)

A second embodiment of the present disclosure is explained.

Figure 4:
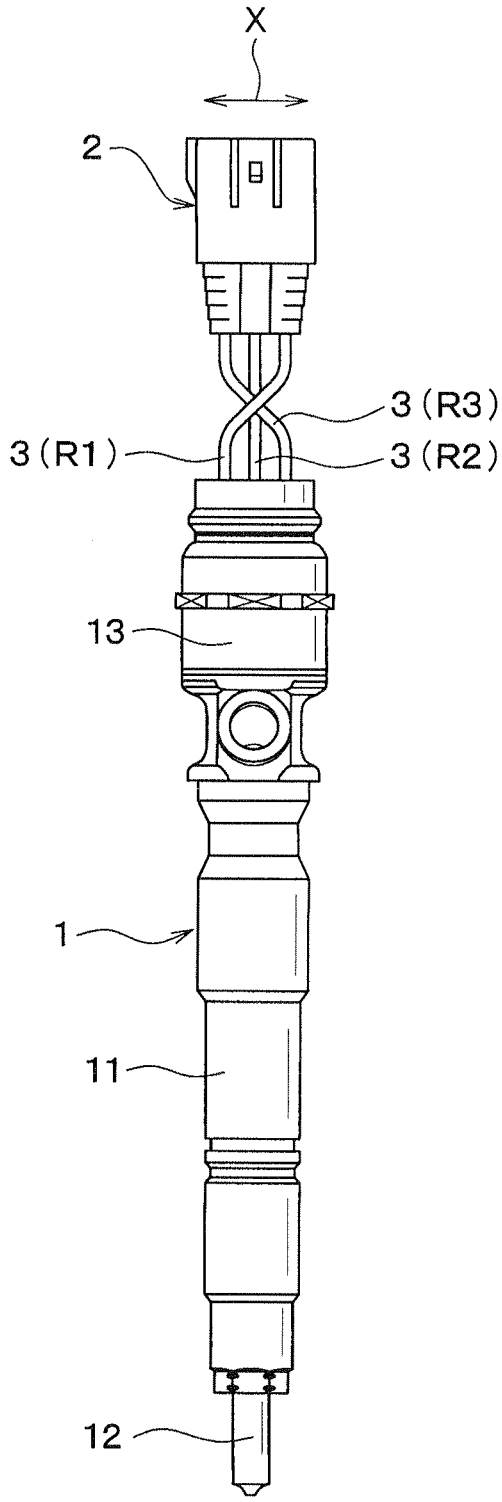
FIG. 4 shows a view of an injector that the electrical wiring structure of a second embodiment of the present disclosure is adopted.
Figure 5A:
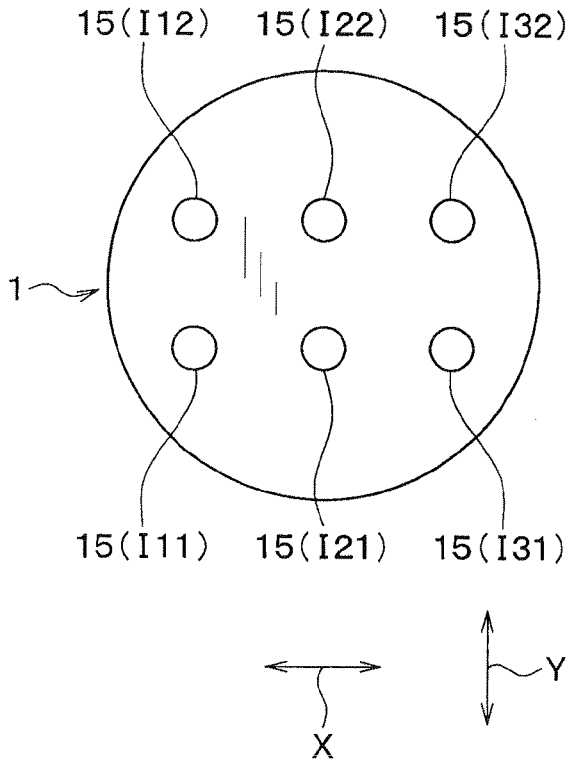
FIG. 5A shows a schematic view showing an arrangement of a first insertion portion of the injector shown in FIG. 4.
Figure 5B:
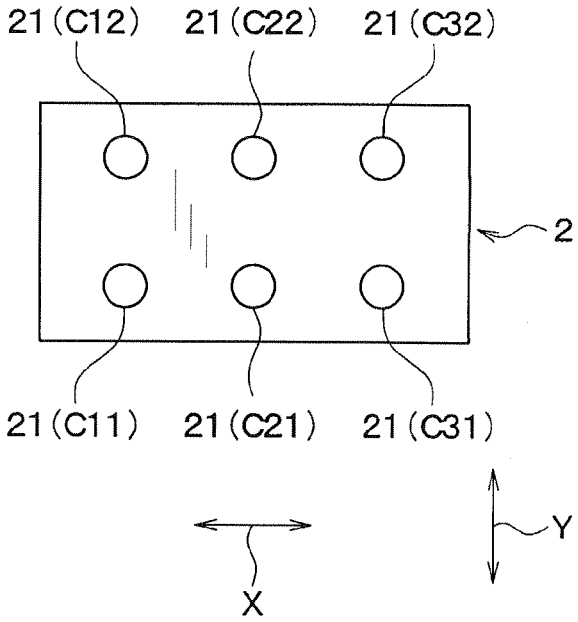
FIG. 5B shows a schematic view showing an arrangement of a second insertion portion of a connector shown in FIG. 4.

In addition, FIG. 5A and FIG. 5B are views that each viewed from a top of FIG. 4 (namely, plan views).

Hereafter, only a different portion from the first embodiment is explained.

As shown in FIG. 5A, the first insertion portions 15 of the injector 1 are arranged in three lines of two columns.

In addition, the six first insertion portions 15 are separately denoted by Iij among FIG. 5A, where i denotes a line number and j denotes a column number.

As shown in FIG. 5B, the second insertion portions 21 of the connector 2 are arranged in three lines of two columns.

In addition, the six second insertion portions 21 are separately denoted by Cij among FIG. 5B, where i denotes a line number and j denotes a column number.

In FIG. 4 and FIG. 5, all of the three lead wires 3 are arranged at each column.

For the first lead wire R1 arranged at the first column, one end thereof is inserted into the first insertion portion I11 at the first line of the first column, and another end thereof is inserted into the second insertion portion C31 at the third line of the first column.

Moreover, for the second lead wire R2 arranged at the first column, one end thereof is inserted into the first insertion portion 121 at the second line of the first column, and another end thereof is inserted into the second insertion portion C21 at the second line of the first column.

Furthermore, for the third lead wire R3 arranged at the first column, one end thereof is inserted into the first insertion portion 131 at the third line of the first column, and another end thereof is inserted into the second insertion portion C11 at the first line of the first column.

Thereby, three lead wires R1, R2 and R3 of the first column cross at an intermediate part (refer to FIG. 4).

Here, lengths of the first lead wire R1 inserted into the first insertion portion I11 at the first line of the first column and the third lead wire R3 inserted into the first insertion portion 131 at the third line of the first column are equal.

Moreover, the first lead wire R1 and the third lead wire R3 are longer than the second lead wire R2 inserted into the first insertion portion 121 at the second line of the first column.

Thereby, the first lead wire R1 and the third lead wire R3 cross in a shape of substantially a letter X when seen along the non-crossing direction Y where the second lead wire R2 is extended as a straight line (refer to FIG. 4).

Moreover, the fourth to sixth lead wires (not shown) arranged at the second column are constituted as well as the first to third lead wires R1-R3 arranged at the first column.

That is, for the fourth lead wire, one end thereof is inserted into the first insertion portion 121 at the first line of the second column, and another end thereof is inserted into the second insertion portion C32 at the third line of the second column.

Moreover, for the fifth lead wire, one end thereof is inserted into the first insertion portion 122 at the second line of the second column, and another end thereof is inserted into the second insertion portion C22 at the second line of the second column.

Further, for the sixth lead wire, one end thereof is inserted into the first insertion portion 132 at the third line of the second column, and another end thereof is inserted into the second insertion portion C12 at the first line of the second column.

Furthermore, the lengths of the fourth lead wire and the sixth lead wire are equal. Moreover, the fourth lead wire and the sixth lead wire are longer than the fifth lead wire.

Figure 6:
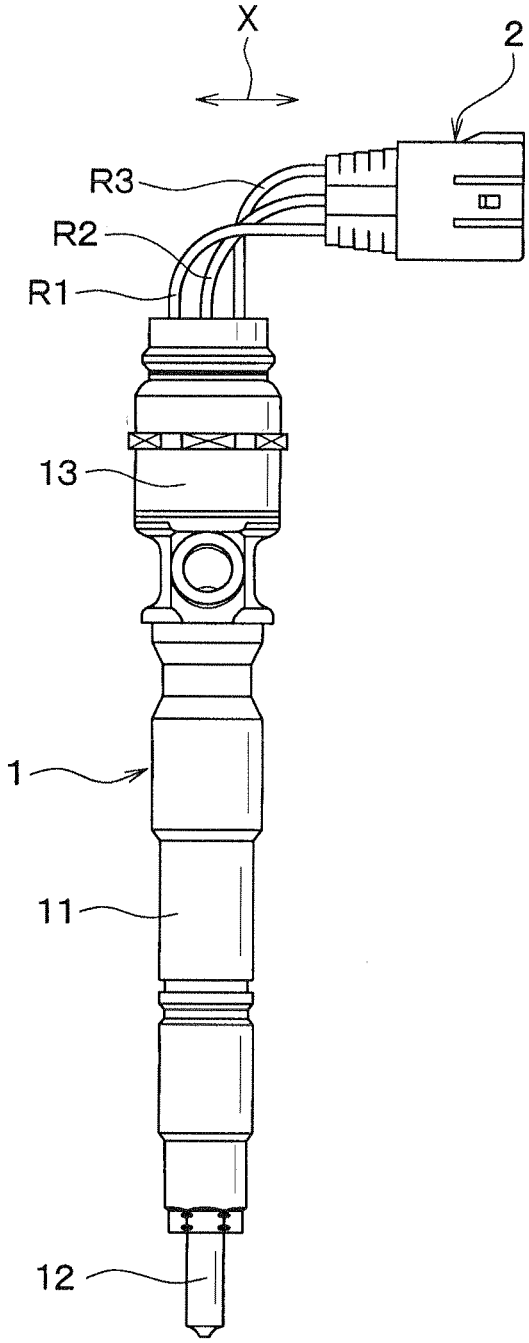
FIG. 6 shows an elevational view of the injector shown in FIG. 4 in a usage state.
Figure 7B:
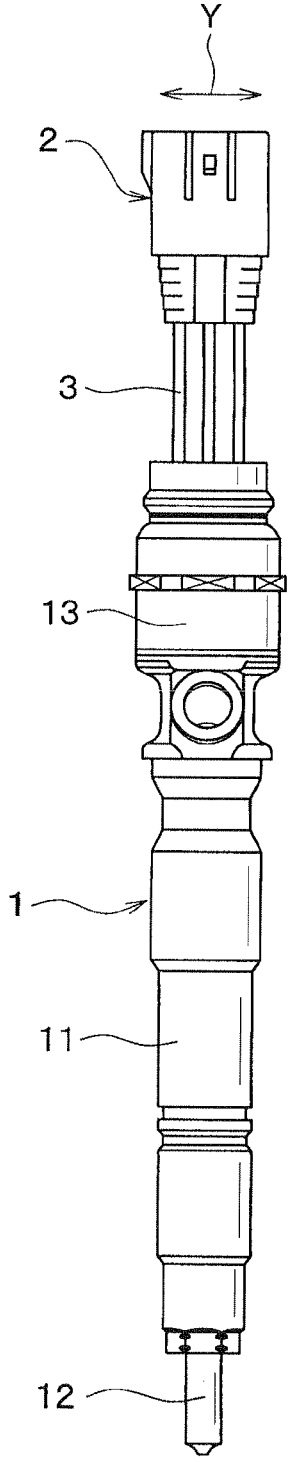
FIG.7B PRIOR ART
FIG. 7B shows a left-hand side view of the injector shown in FIG. 7A.
Figure 7A:
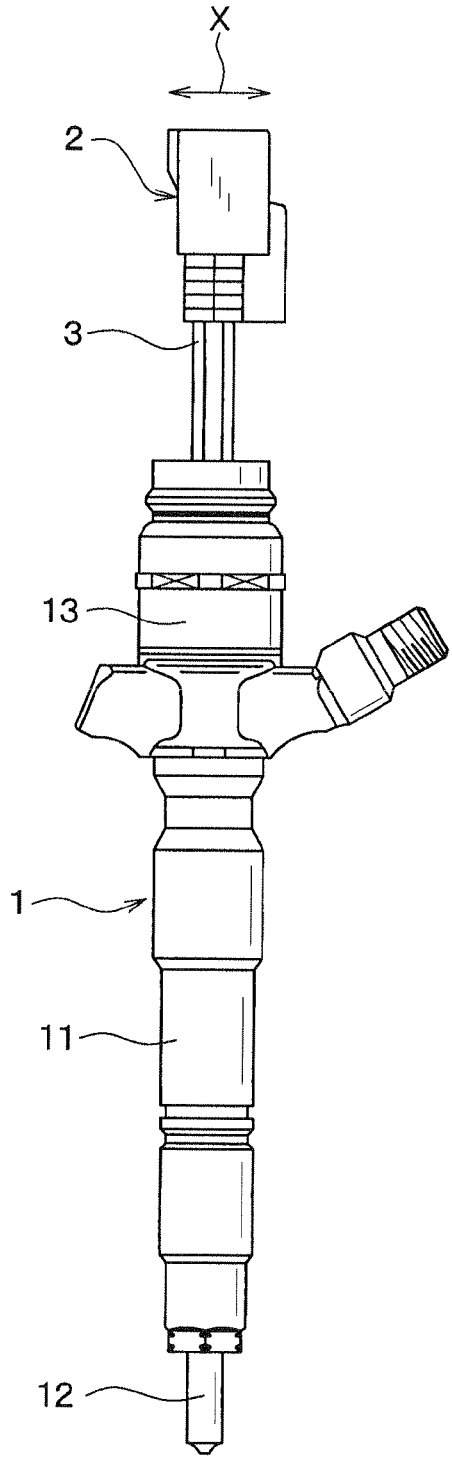
FIG.7A PRIOR ART
FIG. 7A shows an elevational view showing a considered proposal of an injector.
Figure 8:
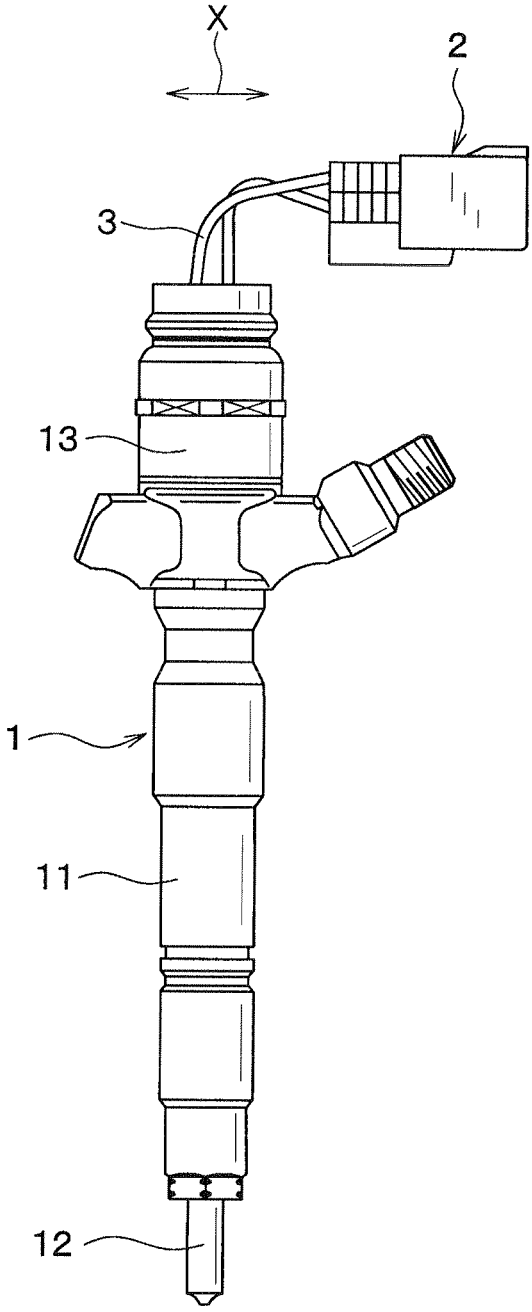
FIG.8 PRIOR ART
FIG. 8 shows an elevational view of the injector shown in FIG. 7A in a usage state.

When the lead wires are 3 bent in the crossing direction X of the three lead wires of each column, the bending radius R of each lead wire 3 becomes substantially equal, as shown in FIG. 6, in the injector 1 with the above composition.

Moreover, since the bending radius R becomes relatively large, the lead wires 3 can be bent easily.

Further, since the restoring force of each lead wire 3 becomes substantially equal, i.e., since the balance of restoring force becomes sufficient, a twist of the lead wire 3 can be avoided.

Furthermore, since it is hard to bend in the non-crossing direction Y, it is easy to maintain a bending direction of the lead wires 3.

(Other Embodiments)

Although the present disclosure is applied to the injector in the embodiments mentioned above, the present disclosure is applicable to other apparatuses than the injector.

What is claimed is:

1. An electrical wiring structure of connecting between a first component and a second component with at least four lead wires, comprising:

the first component provided with first insertion portions in which the lead wires are inserted, and the first insertion portions are arranged in two lines and j columns, and the second component provided with second insertion portions in which the lead wires are inserted, and the second insertion portions are in two lines and j columns, wherein, ends of a pair of lead wires are inserted into the first insertion portions and other ends of the pair of lead wires are inserted into the second insertion portions after crossing at an intermediate part.

2. The electrical wiring structure according to claim 1, wherein, all of the lead wires have equal length.

3. The electrical wiring structure according to claim 1, wherein, the first component is an injector that injects fuel into cylinders of an internal-combustion engine, and the second component is a connector.

4. The electrical wiring structure according to claim 1, wherein at least two of the lead wires each has one end inserted into the first insertion portion having a same column but a different line as the second insertion portion into which the other end is inserted.

5. The electrical wiring structure according to claim 1, wherein each of the at least four lead wires has one end inserted into the first insertion portion having a same column but a different line as the second insertion portion into which the other end is inserted.

6. An electrical wiring structure of connecting between a first component and a second component with at least six lead wires, comprising:

the first component provided with first insertion portions in which the lead wires are inserted, and the first insertion portions are arranged in three lines and j columns, and the second component provided with second insertion portions in which the lead wires are inserted, and the second insertion portions are in three lines and j columns, wherein, among the three lead wires of each column, the lead wire inserted into the second line of the first insertion portion is inserted into the second line of the second insertion portion, and the lead wire inserted into the first line of the first insertion portion and the lead wire inserted into the third line of the first insertion portion are inserted into the second insertion portion after crossing at an intermediate part.

7. The electrical wiring structure according to claim 6, wherein, among the three lead wires of each column, the lead wire inserted into the first line of the first insertion portion and the lead wire inserted into the third line of the first insertion portion have the same length, and are longer than the lead wire inserted into the second line of the first insertion portion.

8. The electrical wiring structure according to claim 6, wherein, the first component is an injector that injects fuel into cylinders of an internal-combustion engine, and the second component is a connector.

9. The electrical wiring structure according to claim 6, wherein at least two of the lead wires each has one end inserted into the first insertion portion having a same column but a different line as the second insertion portion into which the other end is inserted.

10. The electrical wiring structure according to claim 9, wherein at least one of the lead wires has one end inserted into the first insertion portion having a same column and a same line as the second insertion portion into which the other end is inserted.

* * * * *